United States Patent [19]

Blanchet

[11] Patent Number: 4,784,619

[45] Date of Patent: Nov. 15, 1988

[54] ELECTRICAL CONNECTION MODULE

[75] Inventor: Lucien Blanchet, Vésinet, France

[73] Assignee: Air LB, Colombes, France

[21] Appl. No.: 903,527

[22] Filed: Sep. 4, 1986

[30] Foreign Application Priority Data

Sep. 9, 1985 [FR] France ..... 85 13351

[51] Int. Cl.[4] ..... H01R 11/09

[52] U.S. Cl. ..... 439/724

[58] Field of Search ..... 339/198 R, 198 G, 198 GA, 339/198 H, 198 J, 276 SF, 222, 19, 116 R; 439/721-724

[56] References Cited

U.S. PATENT DOCUMENTS

| | | | |
|---|---|---|---|
| 3,597,727 | 8/1971 | Appleton | 339/19 |
| 3,725,852 | 4/1973 | Blanchet | 339/198 |
| 3,993,394 | 11/1976 | Cooper | 339/136 |
| 4,015,889 | 4/1977 | Blanchet | 339/19 |
| 4,557,548 | 12/1985 | Thrush | 339/276 SF |
| 4,580,863 | 8/1986 | Lohr et al. | 339/198 R |
| 4,602,834 | 7/1986 | Hahn et al. | 339/19 |

FOREIGN PATENT DOCUMENTS

| | | |
|---|---|---|
| 1315396 | 2/1962 | France . |
| 1564408 | 5/1967 | France . |
| 2291620 | 11/1974 | France . |
| 635570 | 4/1950 | United Kingdom . |

*Primary Examiner*—Neil Abrams

*Attorney, Agent, or Firm*—Beveridge, DeGrandi & Weilacher

[57] ABSTRACT

An electrical connection module receives terminal pins which are mounted on the ends of wires. The module includes a sheet metal connection piece which is bent into the shape of a pair of adjacent U-shaped sections. Each of these sections has a bottom, one branch provided with pink-guiding bosses, and another branch provided with a contact tongue which engages the pin. One of the branches has an upper portion provided with a locking catch for engaging the locking collar of a terminal pin. The connection piece can be subdivided into portions which are held in a housing which has a closing piece provided with pin-receiving orifices.

7 Claims, 7 Drawing Sheets

ELECTRICAL CONNECTION MODULE

BACKGROUND

The invention relates to electrical connection modules having a certain number of inlets and female connection pieces with a locking facility for male wire-end terminal pin connectors, these connection pieces being arranged in one or more groups insulated from one another and each comprising at least two connection pieces connected electrically to one another inside the housing.

Such connection modules are already known, in particular that described in French Pat. No. 7,437,278 in the Applicant's name. In such a device, there is typically a connection piece with a double groove in the form of a U, which, in one branch of the U, has a stamped double boss serving for guiding the contact part of the male connector and, in the other branch, an elastic tongue clampimg this male connector against the bosses, this connection piece being fastened via the bottom of the housing, whilst the locking catches consist of other elastic tongues bent inwards and belonging to individual locking sleeves likewise introduced via the bottom of the housing and retained by the contact piece.

The production of these various metal components and their assembly in the housing are sufficiently complicated to require considerable manual labor and are very difficult to automate, the more so because the various possibilities of grouping the connections result in a large number of possible models.

The object of the invention is to simplify the production of the components and their assembly, whilst at the same time meeting the wide variety of needs.

SUMMARY OF THE INVENTION

The invention above all entails producing a connection piece with a cross-section in the form of a double U, of which at least one branch of each U has a sufficient height also to make it possible to cut out a locking catch from it, if appropriate the single connection piece for each housing being subdivided longitudinally and/or transversely in order to provide the desired shunts of the configuration.

Moreover, the housing made of molded insulating material has on the inside the longitudinal and/or transverse insulating partitions corresponding to this same configuration and is designed to receive the various shunts from the top, these subsequently being retained by means of a closing piece which is likewise made of molded insulating material and the upper part of which has a certain number of orifices for the passage of the wire-end connectors and penetrates inside the housing over a certain height, this piece being extended downwards by means of parts having an inner surface in the form of a portion of a cylinder and ensuring the guidance of these connectors, whilst at the same time providing room for the various shunts and the possible partitions, this closing piece in turn being finally secured in the housing by means of a fastening piece molded on directly in the housing by means of a mold attached to this housing and to the orifices in the closing piece, the said fastening piece preferably being produced from a flexible material and, if appropriate, being capable at the same time of serving as a sealing piece.

Other particular features of the invention will emerge from the following description of two embodiments taken as examples and illustrated in the attached drawing in which:

DETAILED DESCRIPTION

Figure 3:
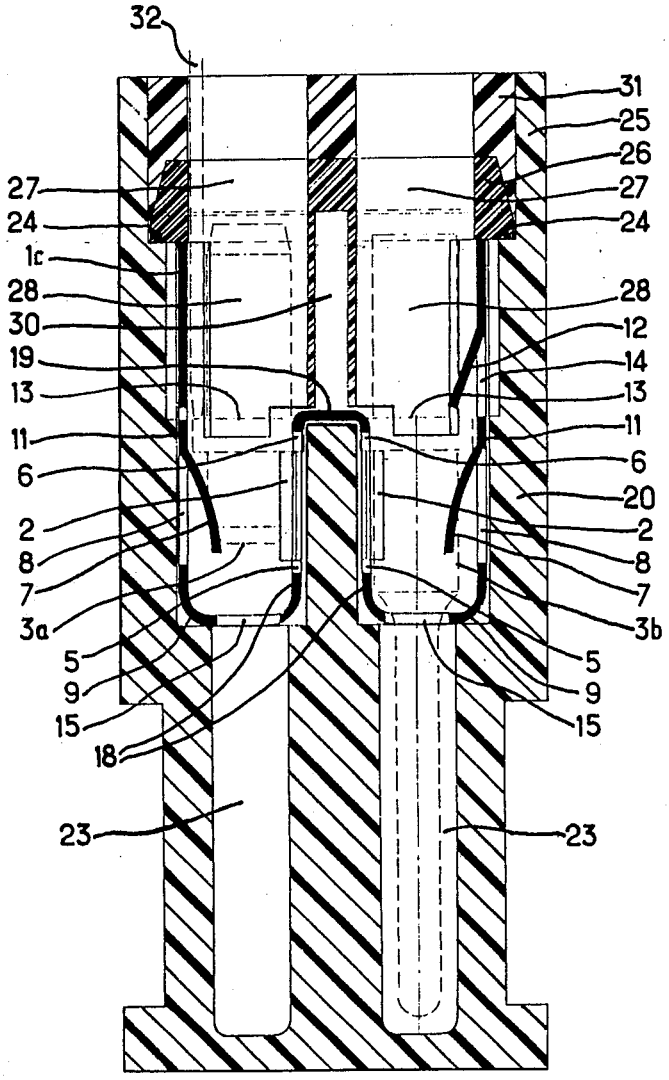
FIG. 3 is a vertical section according to III—III of FIG. 1.
Figure 4:
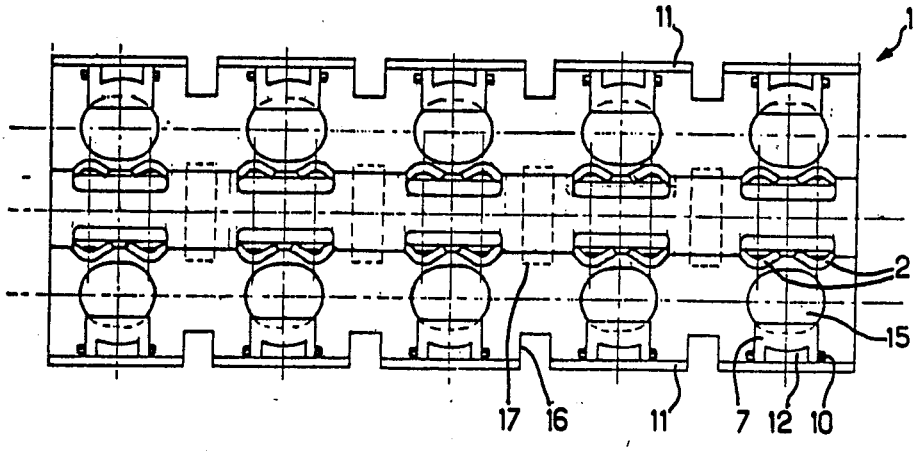
FIG. 4 is a plan view of the metal connection piece.

The essential component of the connection module is, of course, the single metal piece 1 which can be seen as a whole in FIG. 4. As may be seen particularly in FIG. 3, this piece is bent as a whole according to a profile in the form of a double U. Each U-shaped section has a bottom and two opposed branches which are substantially vertical. The piece 1 is produced by cutting and bending using the so-called "tracing" process, each unit, as illustrated in FIG. 4, corresponding to one connection module, that is to say to ten pin locations in the chosen example, without this figure being limiting of course. Production therefore starts from a strip of a metal having a composition and a thickness combining good electrical conductivity and high elasticity. This metal, for example previously subjected to selective gold plating by means of bands or terminals at the subsequent contact points defined by the cutting operation, is first cut out flat and then bent in detail before being bent as a whole.

Figure 1:
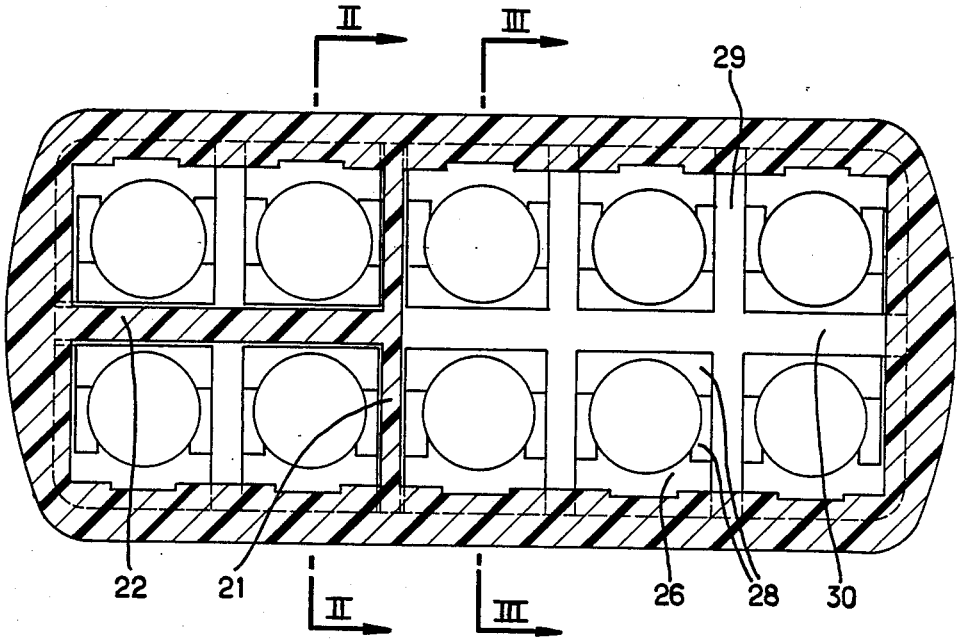
FIG. 1 shows a bottom view of a first embodiment in horizontal section according to I—I of FIG. 2.
Figure 2:
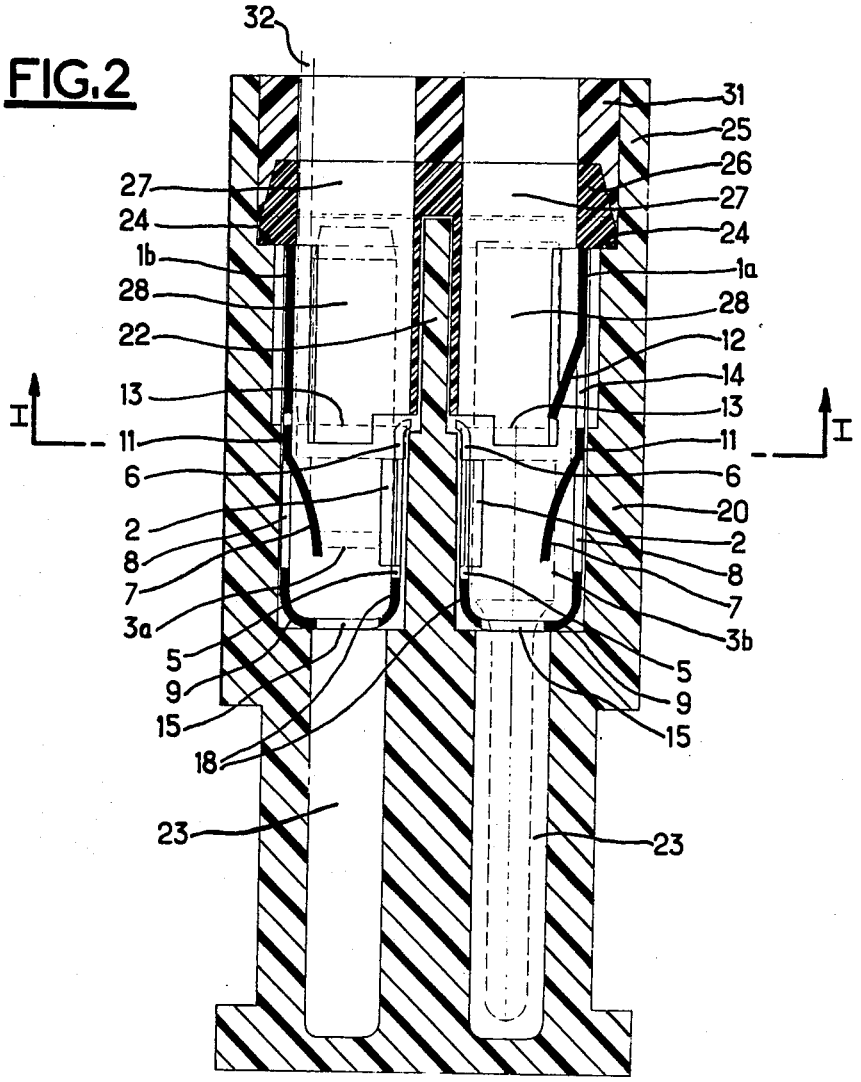
FIG. 2 is a vertical section according to II—II of FIG. 1.
Figure 5:
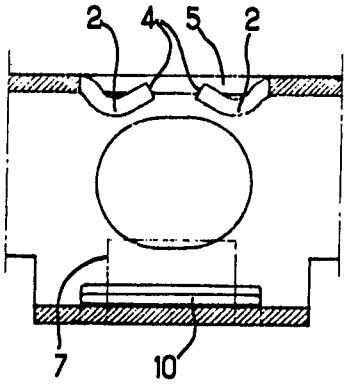
FIG. 5 is an enlarged horizontal section through a fragment of FIG. 4.
Figure 6:
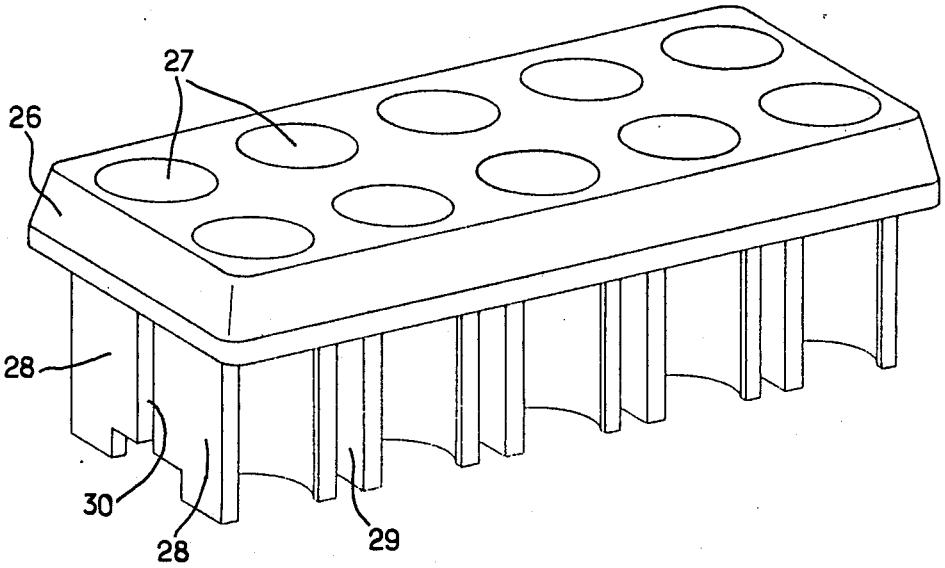
FIG. 6 is a perspective view of the closing piece, still in this first embodiment.

The guide bosses 2 for the male terminal pins, such as 3*a* or 3*b*, represented by broken lines in FIGS. 2 and 3, are made by providing, at the cutting stage, a vertical slit 4 joining the middle parts of two horizontal slits 5 and 6, thus producing an H-shaped cut, so as to isolate two tongues which, at the stage of detailed bending, are folded twice in opposite directions, as shown in detail in FIG. 5, without any elongation of material in contrast to conventional stamping.

The contact tongues 7 located opposite these bosses are obtained in the usual way be making, during the flat cutting operation, a U-shaped cut 8 isolating the tongue 7 which, at the stage of detailed bending, is bent, for example, according to a substantially cylindrical surface with horizontal generatrices in FIG. 3. Finally, at the stage of final bending, the process is concluded by bending the outer corners 9 of the piece, this being made easier by providing in this zone, during the initial cutting operation, weakening slits or orifices 10 substantially in line with the contact tongues 7, to avoid the need to bend the region inaccessible to the bending tool. These orifices 10, which can be seen in FIGS. 4 and 5, have not been marked in FIGS. 2, 3, 8 and 9 for the sake of simplicity. A pin-engaging means is thus provided by the guide bosses 2 and contact tongue of each U-shaped section.

According to the invention, at least one of the branches of each U, here the outer branch 11, is extended upwards by a sufficient amount to provide an upper portion which extends above the pin-engaging means 2, 7 and has an integral locking catch 12 for engaging the locking collar of an inserted terminal pin. The cut out locking catches 12 interact with the upper edge of the collar 13 of each male connector 3*a* or 3*b*. For this purpose, during the initial cutting operation, U-shaped cuts 14 are made once again, and then, during detailed bending, each of the tongues 12 is bent in the direction of the face which will become the inside. At the same time, the tongue 12 is bent in the transverse direction to match the curvature of the part of the terminal pin connector 3*a* or 3*b* located above the collar 13. The surface formed in this way therefore has substantially vertical generatrices.

To ensure that the connection module accepts male connectors of both a short type, such as 3*a*, and a long type, such as 3*b*, an orifice 15 is cut out in the bottom of each U and is preferably made oval in the longitudinal direction of the piece 1, to allow the narrow end of the connectors 3*b* to be recentered in the longitudinal direction of the piece 1, that is to say in the direction of greatest movement permitted by the tongues 7 and the bosses 2, without thereby weakening the cross-section of electrical conductivity in this longitudinal direction. It is appropriate to note that, when the connectors, whether of the short type or of the long type, are pushed in as far as they will go, the lower edge of their collar 13 comes up against the upper edge of the guide bosses 2.

At the initial cutting stage, when the metal piece 1 is flat, the outer branches 11 of each U receive a notch-shaped cut 16 in each gap between two pin locations to make it easier subsequently to separate the single connection piece 1 into a certain number of successive shunts. To achieve the same object, the central part of the initial blank can receive, in the gap between each pair of pin locations, rectangular punchings 17 which extend across and remove portions of the inner branches 18 of the two U's and their upper connection 19. However, to avoid needlessly weakening the mechanical resistance and the conductivity of the piece 1, these rectangular cuts 17 are only made in the necessary places, with a possibility, if appropriate, of omitting the needless punches during the initial cutting operation. Consequently, these orifices 17 are only represented by broken lines in FIG. 4.

Thus, once the single connection piece 1 has been completed, there only remain, between the bottom of the notches 16 and the ends of the rectangular orifices 17, flat parts which can easily be eliminated by means of successive punching, in order to divide the single piece 1 transversely into transverse shunts which each have two, four, six or eight pin-receiving locations. With the same aim in view, it is likewise possible, still in succession, to punch the upper part 19 connecting the inner branches 18 of the U's, in order to divide the piece 1 longitudinally, if already divided transversely, to form longitudinal shunts with 2, 3, 4 or 5 pin locations arranged on each side of the module. The single piece 1 and the countless types of shunts which result from the various combinations can therefore be produced economically by means of less equipment.

These separated shunts, for example 1*a*, 1*b* and 1*c*, obtained as a result of the subdivision of the initial single piece 1, are then introduced via the upper part of an insulating housing 20 which, if appropriate, has transverse partitions 21 or longitudinal partitions 22 corresponding to the selected configuration for the subdivision of these shunts. This housing 20 consequently possesses the receptacles for the shunts, with clearances 23 at the base for the thin lower ends of the pins 3*b*. In the upper part of the housing there is a shoulder 24 surmounted by a thinner part 25.

This housing as a whole then has placed on it a single closing piece 26 provided with orifices 27 for the insertion of the male connectors. Lower extensions 28 of the closing piece 26 ensure the guidance of the male connectors, whilst at the same time provide room for the locking catches 12.

These extensions 28 are therefore delimited by a cylindrical inner surface over more than half their cross-section, this surface serving particularly as a support for the corresponding male connector in order to withstand the thrust of the locking catch 12.

Of course, the closing piece 26 as a whole has transverse clearances 29 or longitudinal clearances 30 forming a passage for the possible partitions 21 or 22, so as to provide a closing piece of a single type. These clearances 29 and 30 are preferably extended in the form of grooves in the continuous part of the piece 26, if, as in the example illustrated, the partitions 21 and 22 rise above the level of the shoulder 24.

Once the closing piece 26 has been placed in the housing 20 and seated against the shoulder 24, the module is placed in a special mold which is sealed around the perimeter of the housing 20 and within the orifices 27, and a thermoplastic is injection-molded on to form the fastening piece 31.

Figure 8:
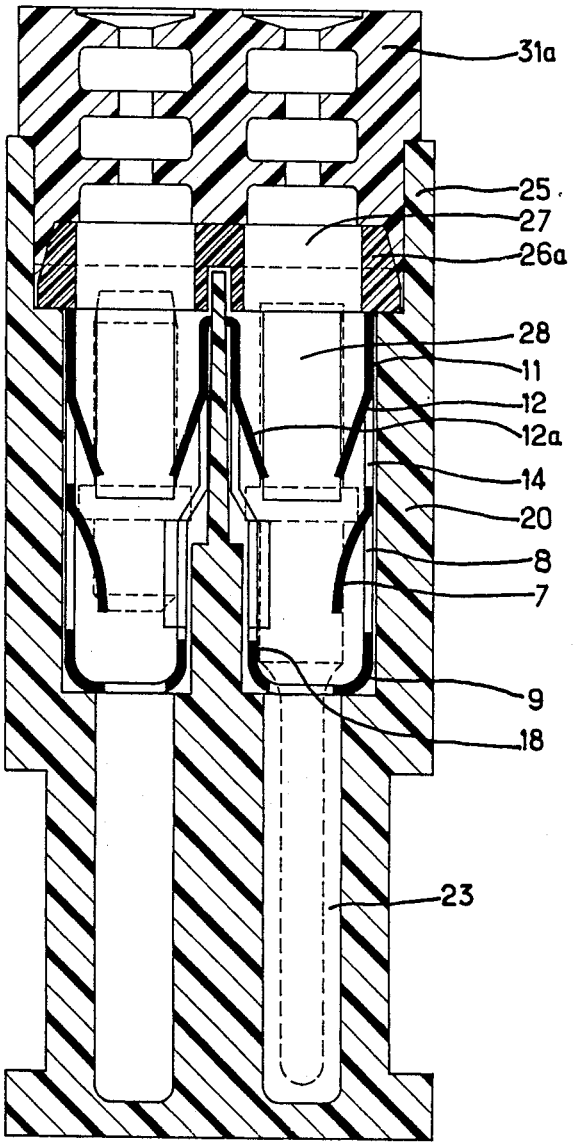
FIGS. 8 and 9 are sections corresponding to FIGS. 2 and 3 through a second embodiment.
Figure 9:
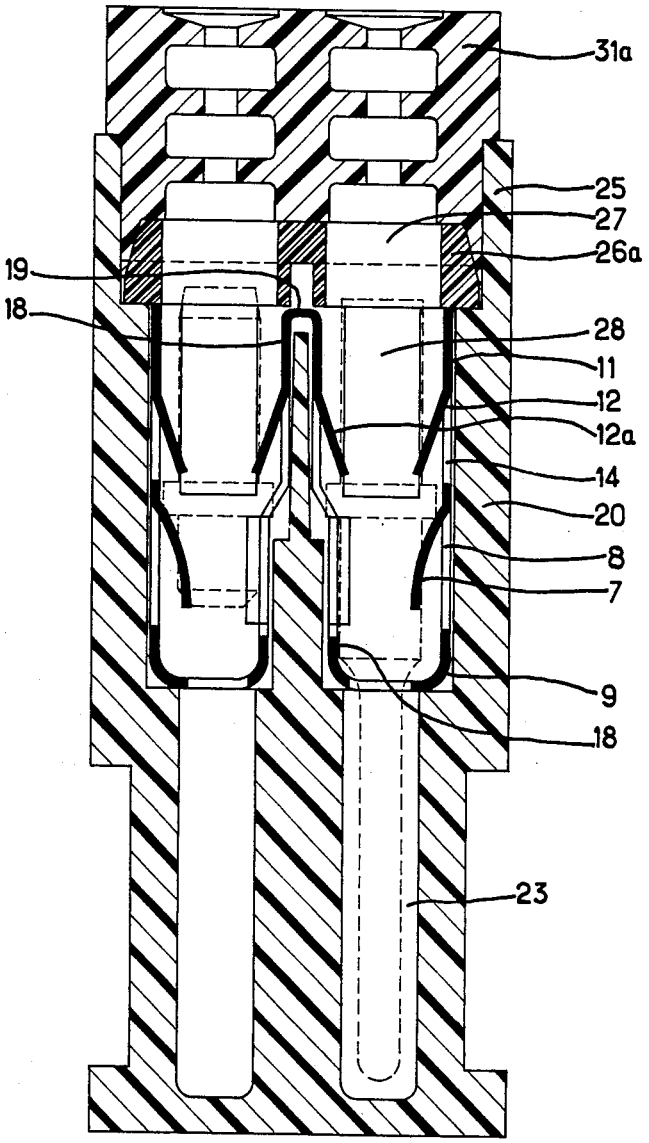

The injected material is preferably a flexible material, thus making it possible as an alternative, as shown in the upper part of FIGS. 8 and 9, to give the fastening piece 31 a configuration 31*a* which allows it at the same time to perform the function of a sealing piece by gripping the electrical wires connected to the corresponding male connectors. This is achieved without an additional component and without any complication in terms of production.

According to a conventional technique, it is known that, in order to remove the male connectors, the locking catches 12 can be released by means of a cylindrical or partially cylindrical tool called "pen tool". This tool can also be used according to the invention, even in the sealed version. Conversely, if an unsealed version is used, such as that in FIG. 3, and if there is a single locking catch 12, as in the chosen example, the orifices 27 can be given a cross-section such as that represented at 27*a* in FIG. 7. This cross-section is formed by a semicircle connected to a half-square, the latter being directed outwards, that is to say towards the locking catches 12. In this case, it is then also possible to release the locking catches 12 by means of a simpler tool consisting of a simple blade designated by 32 in FIGS. 2, 3 and 7; this blade can only be inserted in the correct position because of the shape of the orifices 27*a*.

When a pull is exerted on a conductor wire, the connector of which is locked by means of the single catch 12, the horizontal component of the reaction force attributable to the presence of this single catch is counterbalanced as a result of the bearing of the contact part of the connector 3*a* or 3*b* against the boss 2, the branch 18 then coming up against the partition 22, and as a result of the direct bearing of the collar 13 of the connector against the partition 22.

Figure 7:
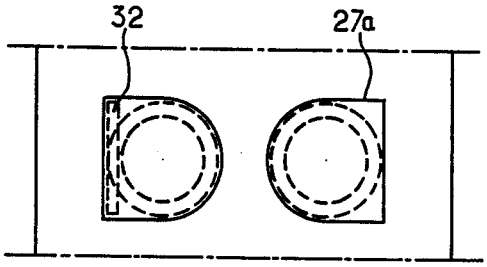
FIG. 7 is a partial plan view of an alternative form of this first embodiment.

The second embodiment, illustrated in FIGS. 8 and 9, is identical in all respects to the preceding one, the only difference being that the inner branches 18 of each U are likewise extended upwards to a sufficient height to make it possible to provide there a second locking catch 12*a* located opposite the catch 12. In this case, of course, the shape of the closing piece 26*a*, similar to 26, is consequently arranged so as to leave room for this second catch, the extensions 28 therefore being subdivided into two parts having an inner surface in the form of a portion of a cylinder and alternating with the two catches 12 and 12*a*. In this case, of course, the release of the two catches requires a conventional pen tool and the solution shown in FIG. 7 is not possible. This second embodiment applies particularly to uses in which a very high tensile strength is required on the wires.

I claim:

1. An electrical connection module for receiving terminal pins which have locking collars and are mounted on the ends of wires, comprising, at least one sheet metal connection piece bent into the shape of a pair of adjacent U-shaped sections, each said U-shaped section having two branches which are spaced apart to receive a terminal pin inserted therebetween, each said U-shaped section having pin-engaging means, each said pin-engaging means including a contact tongue and two guide bosses, said contact tongue being cut and bent out from one branch of a U-shaped section, and the guide bosses being formed in the branch of the U-shaped section which is opposite from the branch where the contact tongue is located, at least one branch of each U-shaped section having an upper portion which extends above said pin-engaging means, said upper portion being provided with an integral locking catch which is cut and bent out from said upper portion and is positioned to engage a locking collar of a terminal pin.

2. The connection module as claimed in claim 1 wherein the guide bosses are formed by an H-shaped cut made in the respective branch, said H-shaped cut including a vertical slit joining two horizontal slits to provide two tongues which are bent to form two reverse folds.

3. The connection module as claimed in claim 1 wherein each U-shaped section has a bottom provided with an oval orifice.

4. The connection module as claimed in claim 1 wherein the connection piece has a plurality of pairs of said U-shaped sections, said piece having lateral notches and rectangular perforations which facilitate the division of the connection piece into separate shunts.

5. The connection module as claimed in claim 1 including an upwardly open one-piece housing made of molded insulating material and providing inner receptacles which receive the entire connection piece including the locking catch, a single closing piece mounted on and closing said housing and being provided with passage orifices for insertion of terminal pins and with lower extensions for guiding the terminal pins, and a thermoplastic fastening piece mounted in said housing and overlying the connection piece.

6. The connection module as claimed in claim 1 wherein the fastening piece is a flexible sealing piece.

7. The connection module as claimed in claim 1 in which the connection piece has only a single locking catch in each U-shaped section, said passage orifices having a cross section in the form of a semicircle connected to a half-square, and the half-square is on the same side as the single locking catch in order to permit insertion of a tool for releasing this catch.

* * * * *